US008362922B2

(12) United States Patent
Kushi et al.

(10) Patent No.: US 8,362,922 B2
(45) Date of Patent: Jan. 29, 2013

(54) INTERSECTION DRIVING SUPPORT APPARATUS

(75) Inventors: Azumi Kushi, Tokyo (JP); Shinji Sawada, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 266 days.

(21) Appl. No.: 12/914,238

(22) Filed: Oct. 28, 2010

(65) Prior Publication Data

US 2011/0102195 A1 May 5, 2011

(30) Foreign Application Priority Data

Oct. 29, 2009 (JP) ..... 2009-249368

(51) Int. Cl.
*G08G 1/09* (2006.01)

(52) U.S. Cl. ..... 340/905; 340/436; 340/903; 701/301

(58) Field of Classification Search ..... 340/905, 340/436, 435, 438, 425.5, 903, 933; 701/36, 701/301
See application file for complete search history.

(56) References Cited

U.S. PATENT DOCUMENTS 5,448,219 A * 9/1995 Yoshikawa et al. ..... 340/436
6,005,491 A * 12/1999 Kopchak et al. ..... 340/907
6,630,892 B1 * 10/2003 Crockford et al. ..... 340/904
7,190,283 B1 * 3/2007 Varian ..... 340/905
7,375,622 B2 * 5/2008 Takata et al. ..... 340/436
8,068,036 B2 * 11/2011 Ghazarian ..... 340/903
2011/0298603 A1 * 12/2011 King et al. ..... 340/436

FOREIGN PATENT DOCUMENTS

JP 2006-185137 7/2006

* cited by examiner

*Primary Examiner* — Toan N Pham

(74) *Attorney, Agent, or Firm* — Smith, Gambrell & Russell LLP

(57) ABSTRACT

When a vehicle attempts to enter a priority road from a non-priority road, a visibility determination processing section compares moving object information on the priority road obtained from a first infrastructure facility installed near a stop position with moving object information on the priority road detected by an autonomous sensor mounted on the vehicle, and determines that the visibility is poor if the former does not match the latter or determines that the visibility is good if the former matches the latter. Then, when the former does not match the latter, the driver is informed of intersection support information. When the former matches the latter, the driver is not informed since it is determined that the driver has already recognized the information by visual observation.

3 Claims, 7 Drawing Sheets

INTERSECTION DRIVING SUPPORT APPARATUS

CROSS-REFERENCE TO RELATED APPLICATIONS

The present application claims priority from Japanese Patent Application No. 2009-249368 filed on Oct. 29, 2009, the entire contents of which are hereby incorporated by reference.

BACKGROUND OF THE INVENTION

1. Field of the Invention

The present invention relates to an intersection driving support apparatus that informs a driver driving a vehicle attempting to enter a priority road from a non-priority road of support information concerning moving objects on the priority road.

2. Description of Related Art

In the related art, generally at an intersection that is not signalized, a traffic sign of "STOP" is put up and a stop line is drawn on the surface of a non-priority road that intersects with a priority road. When a priority road has two lanes, the center line thereof may be drawn without being interrupted on an extension of a non-priority road. Thus, a driver attempting to advance his/her vehicle into a priority road from a non-priority road recognizes that the road on which the vehicle is currently traveling is a non-priority road by visually observing the traffic sign, the stop line or the center line. Then, the driver slows down before the intersection, stops at the stop line and advances into the priority road while making sure that it is safe to advance.

In this case, when a blocking object such as a building is present around the intersection, a driver of a sedan type vehicle or a wagon type vehicle, which has an engine in a front portion of a vehicle body, cannot readily recognize a bicycle or a vehicle traveling on the priority road due to the blocking object even if he/she stops his/her vehicle at a position where a front bumper thereof is over the stop line, because the front end of the vehicle body is far from the driver seat. When the driver attempts to enter a priority road through such a blind intersection, the driver advances at reduced speed so that the front end of his/her vehicle enters the priority road to ensure good visibility and grasps the conditions of the priority road to make sure that it is safe to advance, and then makes his/her vehicle merge onto the priority road.

However, if a vehicle traveling on the priority road is about to pass through the intersection when the driver attempts to advance the front end of his/her vehicle into the priority road, it is likely that the vehicles crash into each other as they enter the intersection. Therefore, in order to prevent such an intersection collision, there have been proposed various driving support apparatuses designed to support a driver by informing the driver attempting to advance his/her vehicle into a priority road of information on the priority road so that the vehicle can advance safely.

For example, Japanese Patent Unexamined Application Publication (JP-A) No. 2006-185137 (hereinafter referred to as Patent Document 1) discloses a technique for calculating the times at which a subject traveling on a non-priority road vehicle and an oncoming vehicle traveling on a priority road arrive at an intersection by means of inter-vehicle communication between the subject vehicle and the oncoming vehicle, and setting an informing timing and an alarming level of support information such as a crash alert according to a traveling condition of the oncoming vehicle at the time when the subject vehicle enters the intersection.

The technique disclosed in Patent Document 1 is disadvantageous in that the driver may feel troublesome because, when for example, entering a priority road from a non-priority road, the driver is informed of every support information as a vehicle traveling on the priority road approaches even if the driver has good visibility of the priority road and can readily grasp the conditions of the priority road by visual observation.

In addition, even if the vehicle traveling on the priority road turned right or left before the intersection and thus the danger of crash with the subject vehicle has disappeared, the alerting support information is continuously informed until the two vehicles are away from each other to by certain distance. In such case, the driver attempting to enter the priority road from the non-priority road believes that a vehicle traveling on the priority road approaches, and therefore he/she may disadvantageously recognize the support information as false information due to the fact that the vehicle does not appear.

SUMMARY OF THE INVENTION

In view of the aforementioned circumstances, the present invention aims to provide an intersection driving support apparatus that informs a driver of a vehicle traveling on a non-priority road attempting to enter a priority road only of necessary support information and not of unnecessary support information, thereby easing a troublesome feeling given to the driver, preventing recognition as false information and attaining high reliability.

To achieve the aforementioned objects, an intersection driving support apparatus according to the present invention includes: information informing means for informing a driver of support information; first moving object information analyzing means for analyzing moving object information on a priority road obtained from a vehicle exterior information source; second moving object information analyzing means for analyzing moving object information on the priority road obtained from an autonomous sensor mounted on a vehicle; visibility determination processing means for comparing the moving object information toward the priority road detected by the second moving object information analyzing means and the moving object information detected by the first moving object information analyzing means of the vehicle traveling on a non-priority road intersecting with the priority road, and determines that the visibility of the intersection is poor due to a blind spot if the former moving object information does not match with the latter or determines that the visibility of the intersection is good if the former moving object information matches with the latter; and support processing means for outputting intersection support information, which informs information concerning a moving object present in a blind spot area, to the information informing means if the visibility of the intersection is determined to be poor by the visibility determination processing means, and does not output the intersection support information if the visibility of the intersection is determined to be good.

Preferably, in this case, when the vehicle arrived at a stop position, if the support processing means determines that a vehicle traveling on the priority road is a vehicle that does not go straight ahead based on updated moving object information analyzed by the first moving object information analyzing means, the support processing means outputs support information, in which information concerning the vehicle on the priority road is excluded from the moving object information, to the information informing means.

According to the present invention, the moving object information on the priority road obtained from the vehicle exterior information source and the moving object information on the priority road obtained from the autonomous sensor mounted on the vehicle are compared, and if the former matches the latter, that is, if the visibility is good and therefore the driver can easily recognize moving objects on the priority road by visual observation, the intersection support information is not informed. Accordingly, a troublesome feeling given to the driver can be eased. On the other hand, if the former does not match the latter, the intersection support information is informed. Accordingly, a sense of security can be provided to the driver.

Even if the moving object information on the priority road obtained from the vehicle exterior information source does not match with the moving object information on the priority road obtained from the autonomous sensor mounted on the vehicle, in the case where a vehicle traveling on the priority road is determined to be a vehicle that does not go straight ahead thereafter, information concerning this vehicle is excluded from the moving object information. Accordingly, when the driver sees passage of moving objects on the priority road by visual observation while attempting to advance the vehicle into the intersection, the moving object grasped by the driver and the moving object information informed by the support information match with each other. Therefore, the driver does not recognize the moving object information as false information, and higher reliability can be attained.

DETAILED DESCRIPTION OF THE PREFERRED EMBODIMENTS

Figure 1:
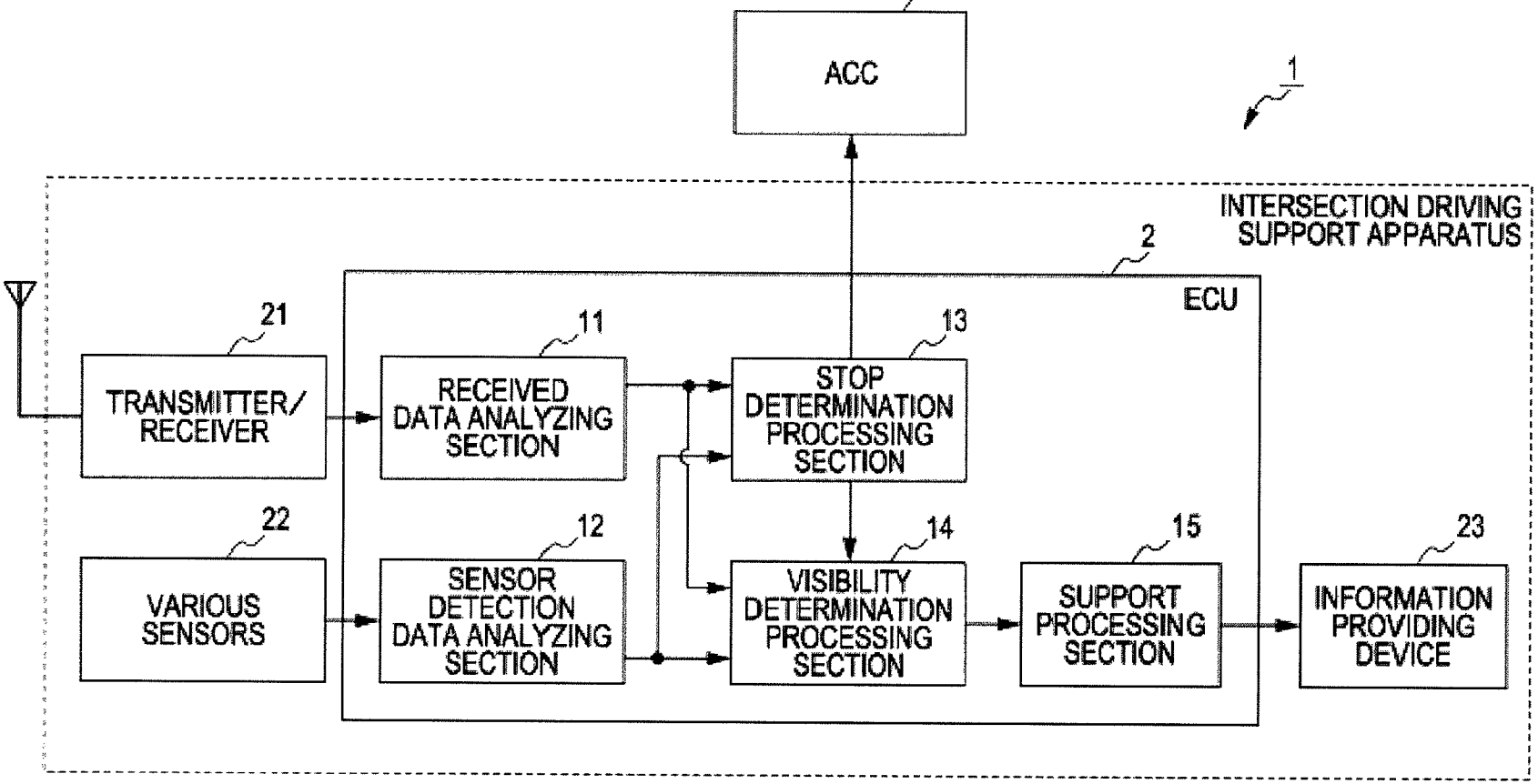
FIG. 1 is a functional block diagram illustrating an intersection driving support apparatus.

An embodiment of the present invention will be described below with reference to the drawings. An intersection driving support apparatus 1 according to the present embodiment is configured to inform a driver of support information for safely merging his/her vehicle onto a priority road when the driver attempts to advance the vehicle into the priority road from a non-priority road, based on information obtained from outside the vehicle and information obtained from sensors 22 mounted on the vehicle.

The intersection driving support apparatus 1 is provided with a controller (ECU) 2. The ECU 2 is mainly composed of a microcomputer and includes, as functions for realizing driving support, a received data analyzing section 11 that is an example of the first moving object information analyzing means, a sensor-detecting data analyzing section 12 that is an example of the second moving object information analyzing means, a stop determination processing section 13, a visibility determination processing section 14 serving as the visibility determination processing means, and a support processing section 15 serving as the support processing means. The support processing section 15 is connected to an information providing device 23 as the information informing means. When an adaptive cruise control (ACC) device 26 is further mounted on the vehicle, it is possible to instruct the ACC device 26 to execute stop control (brake control) by an instruction from the stop determination processing section 13.

The received data analyzing section 11 analyzes vehicle exterior information received by a transmitter/receiver 21 including information on the priority road and information on the non-priority road on which the vehicle is traveling. Examples of information from the vehicle exterior information source include information obtained by means of road-to-vehicle communication with an infrastructure facility (such as a beacon transmitter/receiver including an optical beacon and a radio beacon) installed at a position apart from an intersection by a predetermined distance and information held by a vehicle traveling near the intersection and obtained by means of inter-vehicle communication with the vehicle.

Figure 6:
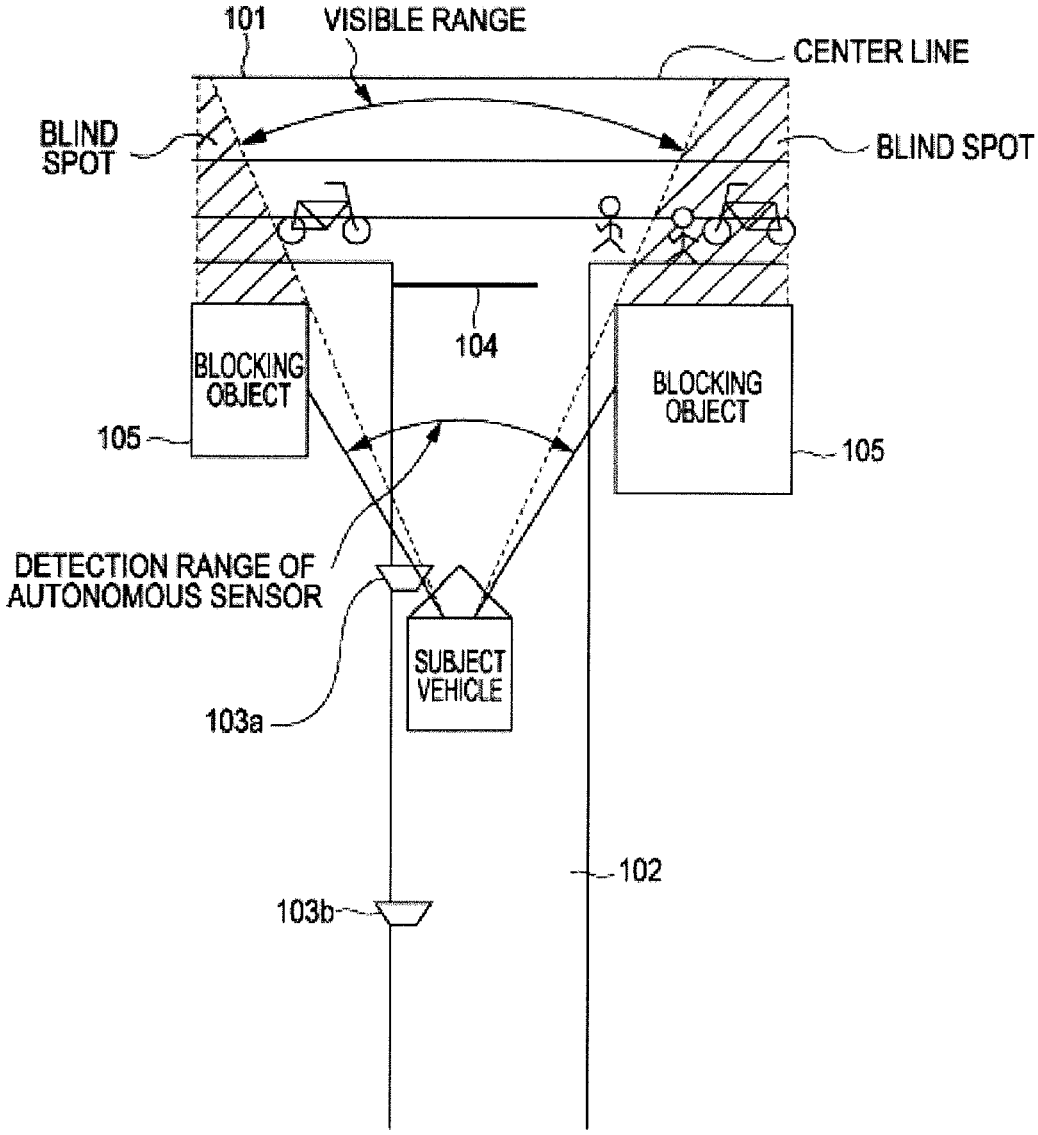
FIG. 6 is a diagram for explaining a condition under which support information is informed when the visibility of a priority road from a non-priority road is poor.

As illustrated in FIG. 6, a case in which first and second infrastructure facilities 103*a* and 103*b* are installed near an intersection where a non-priority road 102 intersects with a priority road 101 to form a T-junction and at a position at some distance from the intersection, respectively, is shown in the present embodiment.

An example of information (first infrastructure information) that can be obtained from the first infrastructure facility 103*a* is moving object information concerning the position, speed and number of objects to pay attention to such as a vehicle, bicycle and pedestrian traveling on the priority road 101. Examples of information (second infrastructure information) that can be obtained from the second infrastructure facility 103*b* include road shape information of the priority road, road shape information of the non-priority road and information on the distance from the infrastructure facility 103*b* to a stop position 104, in addition to the aforementioned moving object information. The stop position 104 is arranged immediately before the intersection on the non-priority road 102. When a stop line is drawn on the road surface, the stop line serves as the stop position 104.

Figure 5:
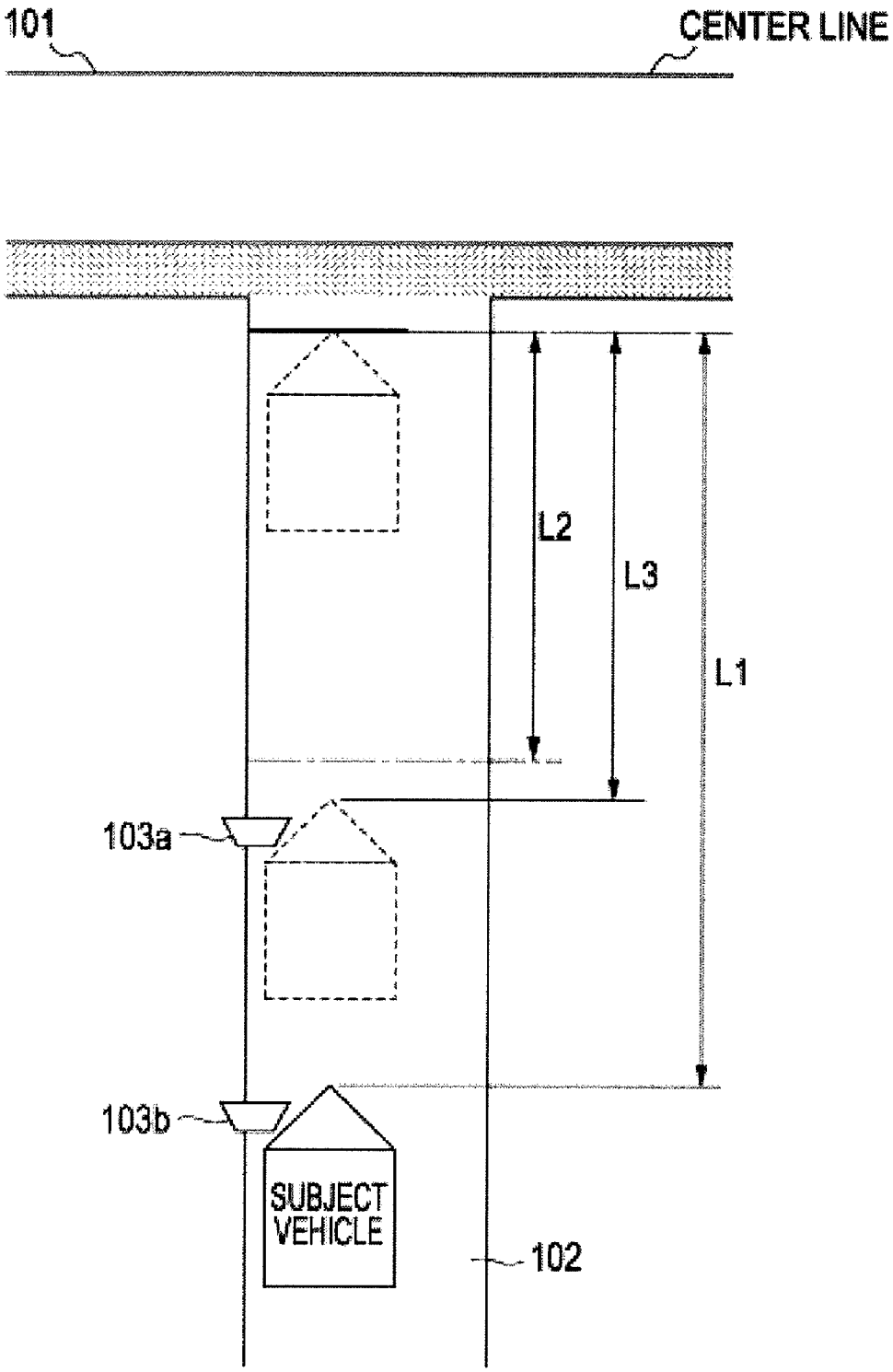
FIG. 5 is a diagram for explaining a condition under which a vehicle entering a priority road from a non-priority road is informed of support information to stop.

The road shape information of the priority road 101 includes information concerning the number of lanes, the width, the presence or absence of a sidewalk of the priority road 101. The road shape information of the non-priority road 102 includes information concerning a condition of the road surface (road surface friction coefficient). Since the second infrastructure facility 103*b* is installed at a position apart from the stop position 104 by a predetermined distance L1 (see FIG. 5) and the first infrastructure facility 103*a* is installed near the stop position 104, the moving object information obtained from the first infrastructure facility 103*a* is more updated as compared to that obtained from the second infrastructure facility 103*b*.

The sensor-detecting data analyzing section 12 analyzes the information detected by various sensors 22 mounted on the vehicle. Examples of the various sensors 22 mounted on the vehicle include an autonomous sensor and vehicle sensors. The autonomous sensor detects environmental information in the traveling direction of the vehicle. Examples of the autonomous sensor include a millimeter wave radar, an infrared sensor and a camera. The presence or absence of a blocking object and a vehicle in front, and the moving object information of objects moving on the priority road 101, including the number, speed and traveling direction of objects to pay attention to, such as a bicycle, pedestrian and vehicle passing through the intersection, are analyzed based on the information detected by the autonomous sensor. When a camera is mounted as the autonomous sensor, a moving object recognized by the camera is subjected to pattern matching, and thereby the type of the moving object can be instantaneously distinguished. Examples of the vehicle sensors include sensors that detect driving conditions of a vehicle, such as a vehicle speed sensor that detects the speed, and a brake switch that detects depression of a brake pedal.

The stop determination processing section 13 calculates a distance (safe stop distance) L2 (see FIG. 5) at which the vehicle can stop at the stop position 104 with a safe deceleration speed based on the data analyzed by the data analyzing sections 11 and 12, and outputs an alarm warning the driver to stop to the information providing device 23 if the driver does not operate the brake even when the vehicle reaches a position in the safe stop distance L2.

When the stop determination processing section 13 determines that the vehicle has reached a position in the safe stop distance L2, the visibility determination processing section 14 compares the moving object information of objects moving on the priority road 101 among the second infrastructure information analyzed by the data analyzing sections 11 and 12 with the moving object information of objects present on the priority road 101 ahead detected by the autonomous sensor provided in the various sensors 22. Then, the visibility determination processing section 14 determines that the visibility of the intersection is poor if the moving object information of the second infrastructure information and the moving object information detected by the autonomous sensor do not match with each other, or determines that the visibility of the intersection is good if they match with each other.

When the visibility determination processing section 14 determines that the visibility of the intersection is poor, the support processing section 15 informs the driver of intersection support information via the information providing device 23 before the vehicle stops at the stop position 104. Further, the support processing section 15 informs entering support information when the vehicle enters the priority road 101 from the stop position 104.

Examples of the information providing device 23 include an image/audio display device using a monitor and a loudspeaker of a car navigation system, an image display device such as a liquid crystal monitor, an audio display device such as a speaker system, a light-emitting display device that displays text information or the like by lighting or blinking a number of aligned light-emitting devices such as LEDs, a buzzer and a warning lamp. The information providing device 23 informs the driver of support information (intersection support information, entering support information) when entering the priority road 101 by means of one or more of visual or auditory informing instruments of image information, audio information and text information.

Figure 2:
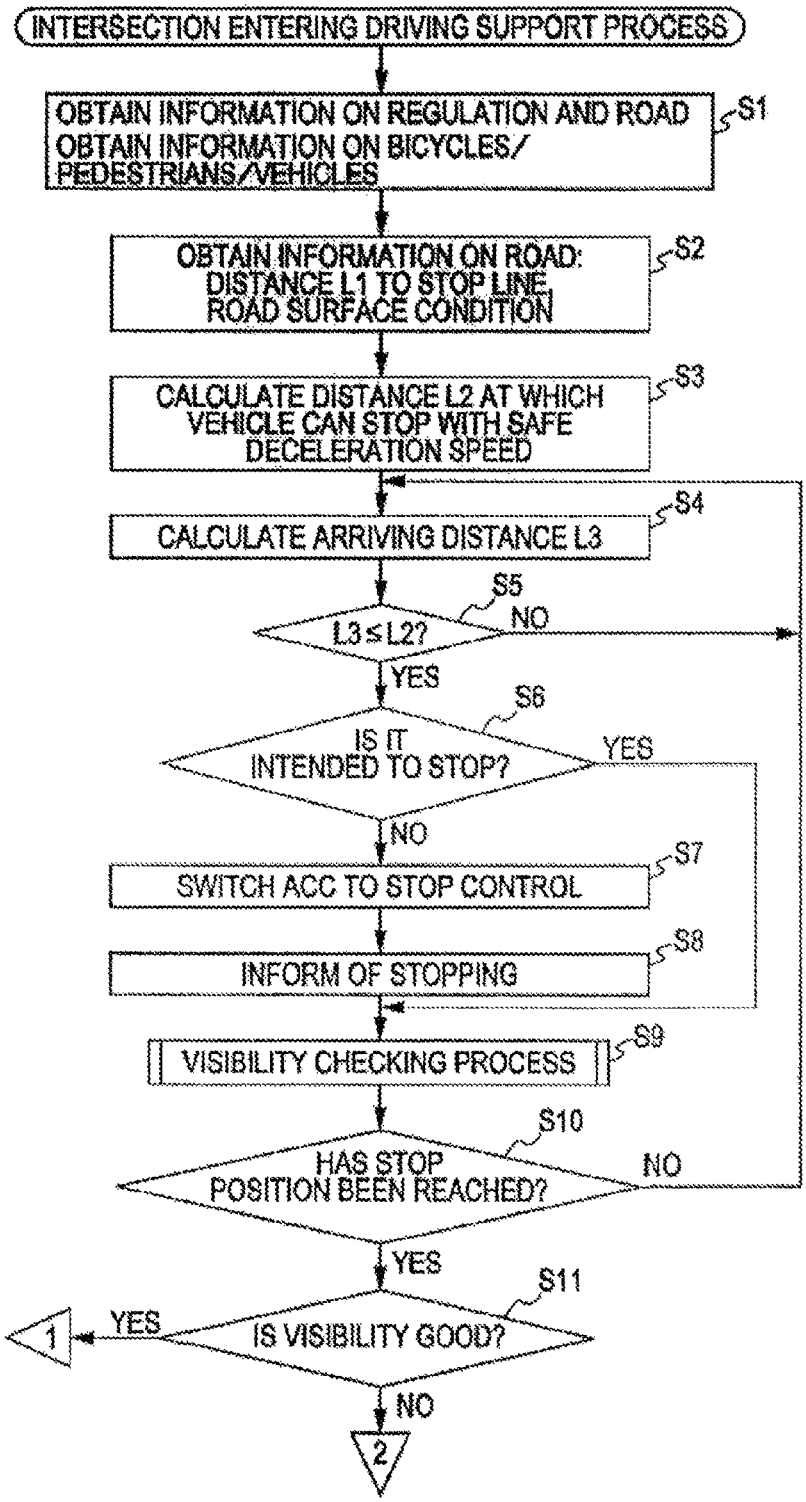
FIG. 2 is a flowchart (1) illustrating an intersection entering driving support process routine.
Figure 3:
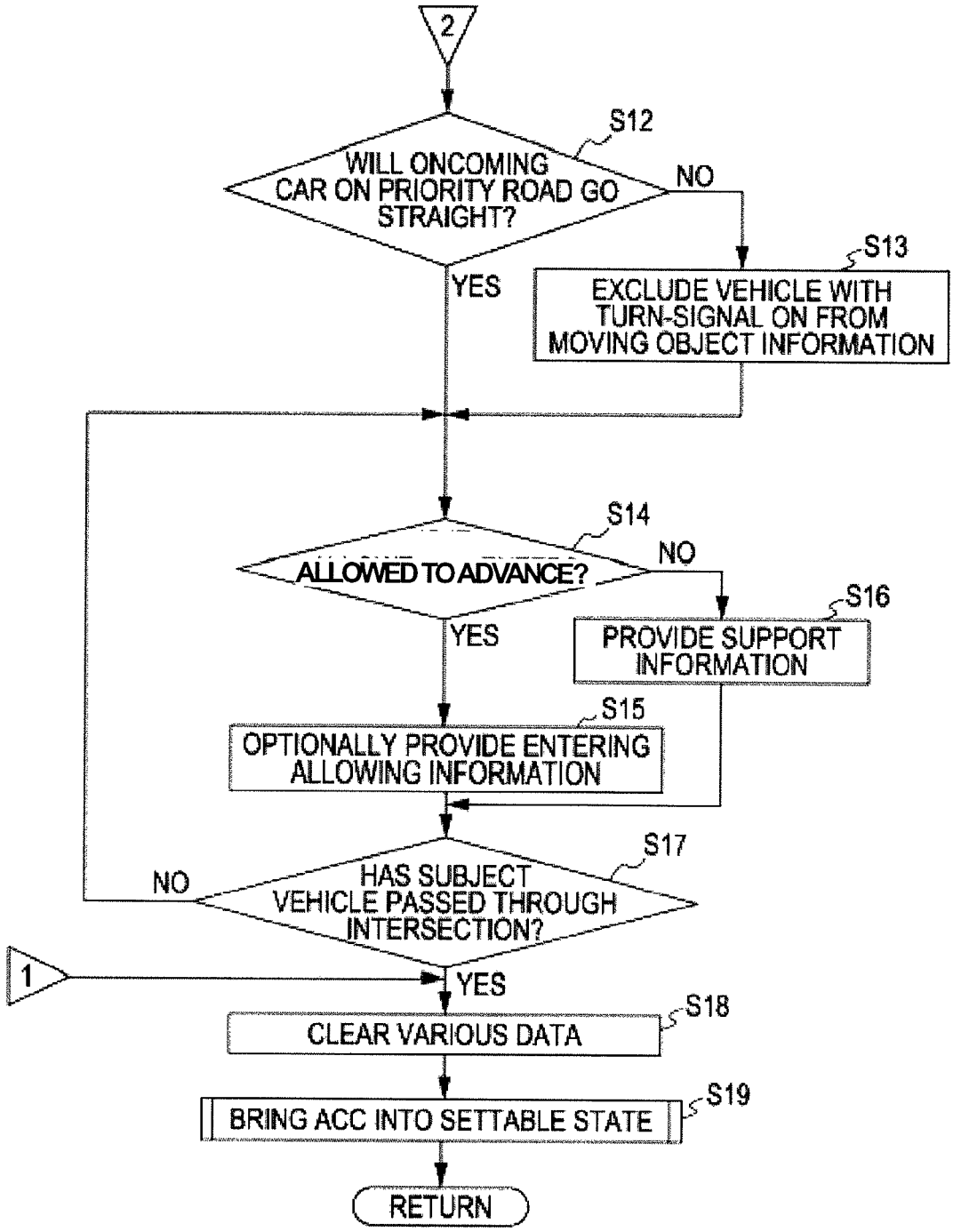
FIG. 3 is a flowchart (2) illustrating an intersection entering driving support process routine.

Specifically, the driving support processes executed by the stop determination processing section 13, the visibility determination processing section 14 and the support processing section 15 described above are executed based on an intersection entering driving support process routine shown in FIGS. 2 and 3.

This routine is initiated when the transmitter/receiver 21 mounted on a vehicle traveling on a non-priority road 102 receives a signal from the second infrastructure facility 103*b*. First, in steps S1 and S2, the processes at the data analyzing sections 11 and 12 are executed. Specifically, in step S1, the second infrastructure information transmitted from the second infrastructure facility 103*b* is analyzed to obtain information on the priority road 101. Examples of the information on the priority road 101 that are obtained include the road shape information of the priority road 101, control information such as reduction to one lane due to roadworks, and the moving object information concerning the position, speed and number of objects to pay attention to, such as a vehicle, bicycle and pedestrian traveling on the priority road 101.

Next in step S2, the road conditions such as a road surface friction coefficient is obtained from the road shape information of the non-priority road 102 on which the subject vehicle is traveling, and the distance L1 between the second infrastructure facility 103*b* and the stop position 104 is also obtained. Further, when the subject vehicle passes by the first infrastructure facility 103*a*, updated road information and moving object information concerning the conditions of the priority road 101 are obtained. As the road surface friction coefficient, a value estimated based on an output of the autonomous sensor may be used.

Next, the routine proceeds to step S3. The process at the stop determination processing section 13 is executed in steps S3 to S8. In step S3, the distance L2 with which the subject vehicle can stop at the stop position 104 while keeping a safe deceleration speed is calculated based on the road surface friction coefficient of the non-priority road 102 and the vehicle speed detected by the vehicle speed sensor.

Then in step S4, a distance (reaching distance) L3 (see FIG. 5) between the vehicle and the stop position 104 is calculated based on the distance (distance between infrastructure facilities) L1 between the second infrastructure facility 103*b* and the stop position 104 that is obtained when the subject vehicle passes by the second infrastructure facility 103*b*, the vehicle speed detected by the vehicle speed sensor and the time elapsed since the subject vehicle passed by the second infrastructure facility 103*b*.

Next in step S5, it is checked whether the reaching distance L3 has reached the safe stop distance L2. If the reaching distance L3 has not reached the safe stop distance L2 yet (L3>L2), the routine returned to step S4 where it is waited until the reaching distance L3 reaches the safe stop distance L2.

Thereafter, when the reaching distance L3 of the subject vehicle reaches the safe stop distance L2 (L3≦L2), the routine proceeds to step S6 where it is checked whether or not the driver intends to stop the vehicle. The determination whether or not the driver intends to stop the vehicle can be made by determining whether or not the driver is operating the brake. Typical examples of a parameter for checking the operation state of the brake include a brake switch that is turned on by a depression of a brake pedal, the vehicle speed, and a brake pressure detected by a brake pressure sensor. When the brake switch is turned on, or when a change amount of the vehicle speed (deceleration speed) detected in every computation period is equal to or greater than a predetermined value or when the brake pressure is equal to or greater than a predetermined value, it is determined that the driver is operating the brake.

If it is determined that the driver is operating the brake, the routine jumps to step S9. If it is determined that the driver is not operating the brake, the routine proceeds to step S7. In step S7, an instruction signal to instruct the ACC device 26 to execute stop control is output, and then the routine proceeds to step S8. Then, the ACC device 26 switches the control mode from a normal ACC control (constant speed cruise control, or follow-up cruise control by which an appropriate distance between a vehicle in front and the subject vehicle is maintained) to the stop control (brake control). The stop control is executed based on the current vehicle speed, the current road surface friction coefficient and the current reaching distance L3.

Next in step S8, the entering support information alerting to stop is output to the information providing device 23 via the support processing section 15, and the routine proceeds to step S9. Then, the information providing device 23 informs the driver to stop the subject vehicle by an auditory instrument such as a buzzer or a voice, or a visual instrument such as blinking of an LED lamp.

When the routine proceeds from step S6 or step S8 to step S9, the process at the visibility determination processing section 14 is executed in steps S9 to S11.

Figure 4:
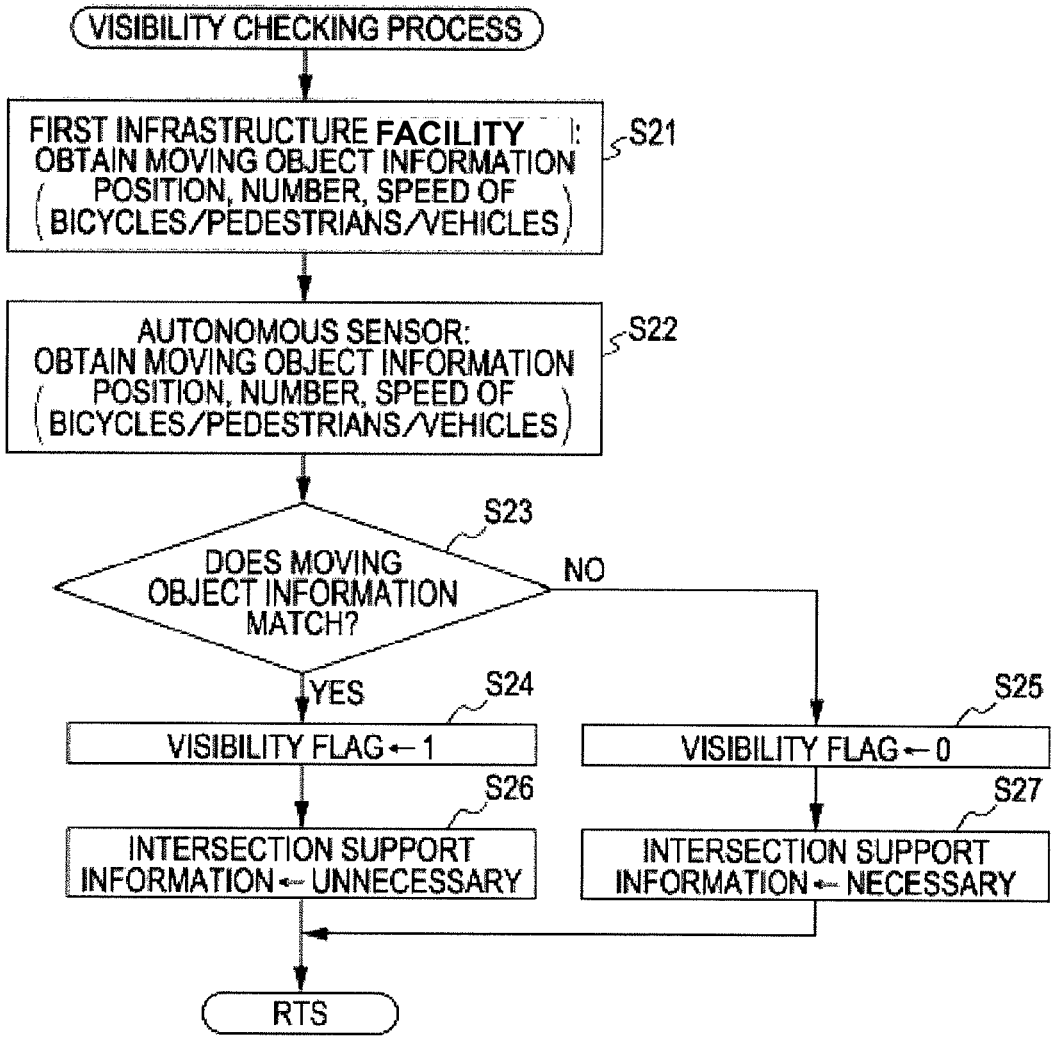
FIG. 4 is a flowchart illustrating a visibility checking process routine.

Firstly in step S9, a visibility checking process to check the visibility of the priority road 101 from the driver is executed. The visibility checking process is executed according to a visibility checking process routine shown in FIG. 4. Here, the visibility checking process routine is described.

According to this routine, firstly in step S21, the position, speed and number of objects to pay attention to, such as a bicycle, pedestrian and vehicle traveling on the priority road 101 are respectively obtained based on the first infrastructure information obtained from the first infrastructure facility 103*a*.

In step S22, the moving object information (the position and speed of objects to pay attention to) on the priority road 101 is obtained based on the environmental information in the traveling direction detected by the autonomous sensor. As shown in FIG. 6, when a detecting range of the autonomous sensor is an area as shown by solid lines but blocking objects 105 such as a building stand near the intersection, the normal detecting range is restricted by the blocking objects 105, which narrows an actual visible range to an area shown by broken lines and produces blind spots shown as hatched areas in FIG. 6. Accordingly, the visibility is reduced by the blind spots.

An example shown in FIG. 6 supposes that the obtained moving object information of the first infrastructure information includes number information of two bicycles and two pedestrians and position information of one bicycle on the left of the intersection and one bicycle and two pedestrians on the right of the intersection. Among the moving objects, the one bicycle and one of the two pedestrians on the right of the intersection in the obtained information are hidden in the blind spot. Therefore, the moving object information obtained by the autonomous sensor will include number information of one bicycle and one pedestrian, and position information of one bicycle on the left of the intersection and one pedestrian on the right of the intersection.

Next in step S23, the moving object information obtained from the first infrastructure facility 103*a* and the moving object information obtained by the autonomous sensor are compared to check whether or not they match each other. If they match with each other, it is determined that the visibility is good, and the routine proceeds to step S24. If the moving object information obtained from the first infrastructure facility 103*a* and the moving object information obtained by the autonomous sensor do not match regarding any one information item, it is determined that the visibility is poor, and the routine proceeds to step S25.

In step S24, a visibility flag is set (visibility flag←1). Then, the routine proceeds to step S26 where the intersection support information is set to be unnecessary. Thereafter, the routine proceeds to step S10 of the intersection entering driving support process routine. On the other hand, in step 25, the visibility flag is cleared (visibility flag←0). Then, the routine proceeds to step S27 where the intersection support information is set to be necessary, and thereafter to step S10 of the intersection entering driving support process routine. Therefore, under the circumstances as shown in FIG. 6, it is determined that the visibility of the intersection is poor (visibility flag←0).

If the intersection support information is set to be necessary to be provided, the visibility determination processing section 14 outputs the intersection support information to the information providing device 23 via the support processing section 15. Then, the information providing device 23 informs the driver of the intersection support information by outputting a voice corresponding to the intersection support information. The intersection support information is informed while the subject vehicle is decelerated between the position in the safe stop distance L2 and the stop position 104. The informed intersection support information may be simply an alert to be careful of an intersection collision because some objects to pay attention to are hidden in the blind spots, or may specifically inform the type (vehicle, bicycle, or pedestrian), approaching direction, number or other information of the objects to pay attention to that are hidden in the blind spots.

Since the driver is informed of the intersection support information that indicates the presence of objects to pay attention to that are hidden in the blind spots before stopping at the stop position 104, the driver can carefully drive as the vehicle moves closer to the intersection, which results in preventing a crash with an oncoming object. On the other hand, if the visibility of the intersection is good, i.e. under circumstances that the driver can easily see the conditions around the intersection by visual observation to make sure that it is safe to advance, the intersection support information is not informed. Therefore, the conditions that are already confirmed by the driver is not informed again, which eases a troublesome feeling given to the driver.

In step S10 of the intersection entering driving support process routine, it is checked whether or not the subject vehicle has reached the stop position 104. The determination whether or not the subject vehicle has reached the stop position 104 is made by determining whether or not the reaching distance L3 has reached $0\pm\alpha$ ($\alpha$: allowable error). If the reaching distance L3 has not reached the stop position 104, the routine returns to step S4. On the other hand, if it is determined that the reaching distance L3 has reached the stop position 104, the routine proceeds to step S11.

In step S11, the visibility is checked by referring to the value of the visibility flag. If the visibility flag is set (visibility flag=1), it is determined that the visibility is good and the routine jumps to step S18. On the other hand, if the visibility flag is cleared (visibility flag=0), it is determined that the visibility is poor and the routine proceeds to step S12.

When the routine proceeds to step S12, the process at the support processing section 15 is executed in steps S12 to S19. First in step S12, it is checked whether or not an oncoming vehicle (priority vehicle) traveling on the priority road 101 attempts to go straight through the intersection.

The determination whether or not the oncoming vehicle (priority vehicle) attempts to go straight through the intersection is determined based on updated moving object information transmitted from the first infrastructure facility 103*a*. Specifically, if the result of analysis based on the updated moving object information transmitted from the first infrastructure facility 103*a* shows that a turn-signal lamp of the oncoming vehicle is blinking and the oncoming vehicle is decelerated before the intersection, it is determined that the oncoming vehicle does not go straight. Alternatively, if it is detected that a turn-signal switch of the oncoming vehicle is ON and the oncoming vehicle is decelerated before the intersection by inter-vehicle communication with the oncoming vehicle traveling on the priority road 101, it is determined that the oncoming vehicle does not go straight.

Figure 7:
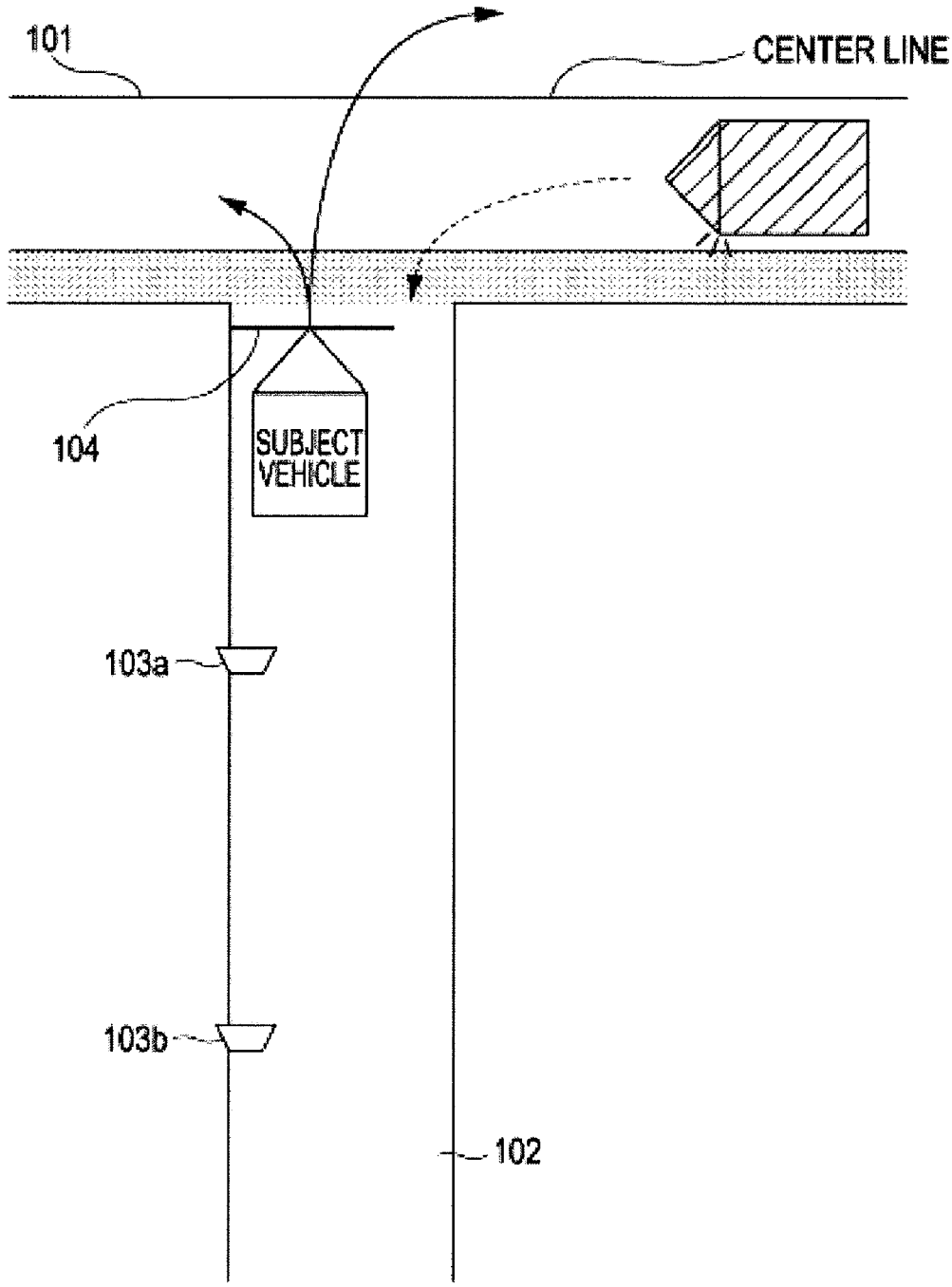
FIG. 7 is a diagram for explaining a case in which a driver of a vehicle entering a priority road from a non-priority road is not informed of support information.

If it is detected that the oncoming vehicle (priority vehicle) goes straight, the routine proceeds to step S14 without changing the data concerning vehicles in the moving object information obtained from the first infrastructure facility 103*a*. On the other hand, if a vehicle (not-going-straight vehicle) that does not go straight ahead is detected in oncoming vehicles (priority vehicles), the routine proceeds to step S13 where the not-going-straight vehicle is excluded from the objects to pay attention to, and then proceeds to step S14. Therefore, as shown in FIG. 7, if one oncoming vehicle (priority vehicle) coming from the right on the priority road 101 is decelerated while blinking the left turn-signal lamp as it approaches the intersection, it is determined that the oncoming vehicle (priority vehicle) does not go straight and the oncoming vehicle is excluded from the objects to pay attention to. In this case, the driver is not informed of the entering support information as will be described later.

When the routine proceeds to step S14 from step S12 or S13, an entering allowability determination is performed to determine whether the subject vehicle can be advanced safely from the non priority road 102 into the priority road 101. This entering allowability determination is made based on the moving object information obtained from the first infrastructure facility 103*a* and based on the speed of objects to pay attention to, such as a vehicle, bicycle and pedestrian, traveling on the priority road 101 and the time elapsed since the moving object information was obtained. If there is no possibility that the subject vehicle crashes with any of the objects when the subject vehicle enters the priority road 101, it is determined that the vehicle is allowed to enter and the routine proceeds to step S15. On the other hand, if there is a possibility that the vehicle crashes with an object, the routine proceeds to step S16.

In step S15, the entering support information for alerting when the vehicle attempts to enter is not informed, but entering allowing information in audio such as "Check the safety on the left and right sides before going ahead," for example, is informed for alerting, and then the routine proceeds to step S17. The entering allowing information does not have to be provided. In such case, the driver may be allowed to select whether or not to receive the entering allowing information by operating an operation switch.

In step S16, on the other hand, the entering support information is provided, and then the routine proceeds to step S17. The entering support information is basically based on the moving object information obtained from the first infrastructure facility 103*a*. However, if there is a vehicle excluded in step S13 described above, information concerning this vehicle is excluded from the entering support information.

As a result, when the subject vehicle attempts to enter the priority road 101 after stopping at the stop position 104, the entering support information is output from the information providing device 23 and informed to the driver if it is set that the entering support information needs to be provided. If the entering support information is provided in audio, the type (vehicle, bicycle, pedestrian), approaching direction and number of the objects to pay attention to that are attempting to enter the intersection on the priority road 101 are informed. At this time, since the not-going-straight vehicle is excluded from the objects to pay attention to in step S13, the entering support information that informs approaching of the not-going-straight vehicle is not informed when the not-going-straight vehicle enters the non-priority road 102, for example. Thus, since the entering support information for a vehicle that can be confirmed by visual observation by the driver is not informed, a troublesome feeling given to the driver can be eased.

For example, if a vehicle is informed as a priority vehicle present in a blind spot in the intersection support information informed when the subject vehicle is near the stop position 104 but is recognized as not-going-straight vehicle as a result that the priority vehicle has already turned right or left before the intersection when the subject vehicle arrives at the stop position 104, the not-going-straight vehicle is excluded from the entering support information. Accordingly, information concerning the not-going-straight vehicle is not informed when the subject vehicle enters the priority road 101 from the stop position 104. As a result, when the driver attempts to advance the subject vehicle into the priority road 101 from the stop position 104, the number and type of the objects to pay attention to traveling on the priority road 101 that are recognized by the driver match with those of the objects to pay attention to informed by means of the entering support information. Accordingly, the driver does not recognize them as false information, and higher reliability can be attained.

Further, if it is determined in step S14 described above that the subject vehicle can enter the priority road 101 safely, the driver is informed of the safety. Accordingly, it is possible to provide a sense of security to the driver.

In step S17, it is checked whether or not the subject vehicle has passed through the intersection, that is, whether the subject vehicle has merged onto the priority road 101. If the subject vehicle has not passed through the intersection, the routine returns to step S14. On the other hand, if it is determined that the subject vehicle has passed through the intersection, the routine proceeds to step S18 where various stored data are cleared (initialized), and then to step S19 where the setting of the ACC device 26 is permitted and the routine is exited.

The ACC device 26 is automatically released when the subject vehicle is stopped at the stop position 104. Then, the ACC device 26 cannot be reset until it is brought into a settable state in step S19. Therefore, even if the follow-up cruise control is executed on the subject vehicle traveling on the non-priority road 102 to follow a vehicle in front, the ACC device 26 is automatically released when the subject vehicle stops at the stop position 104. Accordingly, the subject vehicle does not enter the priority road 101 by following the vehicle in front.

As described above, according to the present embodiment, if a blind spot is produced due to the blocking object 105 near the intersection when a vehicle attempts to enter the priority road 101 from the non-priority road 102, the presence of an object to pay attention to, such as a vehicle, bicycle and pedestrian, that is hidden in the blind spot is informed. Accordingly, it is possible to provide a sense of security to the driver, allow more careful driving when the vehicle comes to an intersection, and prevent an intersection collision.

In addition, if an oncoming vehicle traveling straight ahead on the priority road 101 turns right or left when the subject vehicle attempts to enter the priority road 101 from the non-priority road 102, the oncoming vehicle is excluded from objects to pay attention to. Accordingly, the driver is not informed of information concerning the oncoming vehicle and thus does not recognize as false information.

What is claimed is:

1. An intersection driving support apparatus comprising:

information informing means for informing a driver of support information;

first moving object information analyzing means for analyzing moving object information on a priority road obtained from a vehicle exterior information source;

second moving object information analyzing means for analyzing moving object information on the priority road obtained from an autonomous sensor mounted on a vehicle;

visibility determination processing means for comparing the moving object information on the priority road detected by the second moving object information analyzing means and the moving object information detected by the first moving object information analyzing means of the vehicle traveling on a non-priority road intersecting with the priority road, and determines that the visibility of the intersection is poor due to a blind spot if the former moving object information does not match with the latter or determines that the visibility of the intersection is good if the former moving object information matches with the latter; and support processing means for outputting intersection support information, which includes information concerning a moving object present in a blind spot area, to the information informing means if the visibility of the intersection is determined to be poor by the visibility determination processing means, and does not output the intersection support information if the visibility of the intersection is determined to be good.

2. The intersection driving support apparatus according to claim 1, wherein the support processing means outputs the intersection support information to the information informing means before the vehicle reaches a stop position immediately before the intersection.

3. The intersection driving support apparatus according to claim 1, wherein when the support processing means determines that a vehicle traveling on the priority road is a vehicle that does not go straight ahead based on updated moving object information analyzed by the first moving object information analyzing means, the support processing means outputs intersection support information, in which information concerning the vehicle is excluded from the moving object information, to the information informing means.

* * * * *